United States Patent [19]

Bracegirdle et al.

[11] Patent Number: 4,784,216

[45] Date of Patent: Nov. 15, 1988

[54] HEATING AND/OR DRYING APPARATUS

[75] Inventors: Paul E. Bracegirdle, P.O. Box 113, Penndel, Pa. 19047; David L. Garbelman; Stuart W. Murray, both of Edmond, Okla.; George W. Swisher, Jr., Oklahoma City, Okla.

[73] Assignees: Paul E. Bracegirdle, Penndel, Pa.; CMI Corporation, Oklahoma City, Okla.

[21] Appl. No.: 905,367

[22] Filed: Sep. 8, 1986

[51] Int. Cl.[4] ..... F25B 29/00; F26B 17/12; E01C 19/10

[52] U.S. Cl. ..... 165/64; 165/84; 165/169; 165/110; 165/920; 34/175; 34/177; 366/12

[58] Field of Search ..... 34/175, 177; 432/58, 432/99, 100; 165/909, 920, 108, 64, 110, 169, 84

[56] References Cited

U.S. PATENT DOCUMENTS

| | | | |
|---|---|---|---|
| Re. 32,206 | 7/1986 | Bracegirdle | 366/7 |
| 625,358 | 5/1899 | Schock | 34/175 X |
| 1,188,081 | 6/1916 | Kirschbraun | 34/175 |
| 1,763,538 | 6/1930 | Randolph | 34/175 |
| 2,473,641 | 6/1949 | Feldstein | 165/108 X |
| 2,491,194 | 12/1949 | McShea | 257/6 |
| 2,519,148 | 8/1950 | McShea | 165/64 X |
| 2,622,342 | 12/1952 | Gouloumes et al. | 34/65 |
| 2,900,109 | 8/1959 | Hooper et al. | 222/1 |
| 3,131,035 | 4/1964 | Erickson | 34/77 |
| 3,592,453 | 7/1971 | Jager | 34/79 |
| 3,627,014 | 12/1971 | Nishikawa et al. | 165/4 |
| 3,793,745 | 2/1974 | Myers | 34/189 |
| 4,126,519 | 11/1978 | Murray | 201/32 |
| 4,218,832 | 8/1980 | Daniels | 165/909 X |
| 4,245,915 | 1/1981 | Bracegirdle | 366/12 |
| 4,277,180 | 7/1981 | Munderich | 366/7 |
| 4,279,592 | 7/1981 | Grant | 432/105 |
| 4,375,959 | 3/1983 | Powell | 432/223 |
| 4,583,301 | 4/1986 | Crowley et al. | 34/177 |

OTHER PUBLICATIONS

"EEM An Energy Efficient, Pollution Free Mixing Process", Iowa Manufacturing Company, no date given.

"Energy Conservation on Asphalt Plants", J. Don Brock, Astec Industries, Inc., 1980.

*Primary Examiner*—Michael Koczo
*Assistant Examiner*—Peggy A. Neils
*Attorney, Agent, or Firm*—Panitch, Schwarze, Jacobs & Nadel

[57] ABSTRACT

This application discloses several components relating to a heating apparatus which preferably are used in conjunction with each other in an apparatus for heating solid granular or particulate material, such as aggregate used to make asphalt concrete. One component of the present invention includes a heater-condenser unit which indirectly heats the material by circulating heat transfer fluid within hollow plates contained in a housing holding the material. The material is heated, the heat transfer fluid is condensed and a condensate removal means associated with the hollow plates removes the condensate from the housing. The heat transfer fluid used in the heater-condenser preferably is supplied in the form of a vapor or gas evolved from liquid contained in material heated by another type of heater. In this other type of heater, the material to be dried enters a chamber containing hollow heat exchange plates through which a primary heat transfer fluid is circulating. The material is heated to a temperature at which the liquid is evaporated and the evolved vapor is collected within the heater, routed through an accumulating apparatus and transferred out of the heater to the heater-condenser.

7 Claims, 10 Drawing Sheets

FIG.3
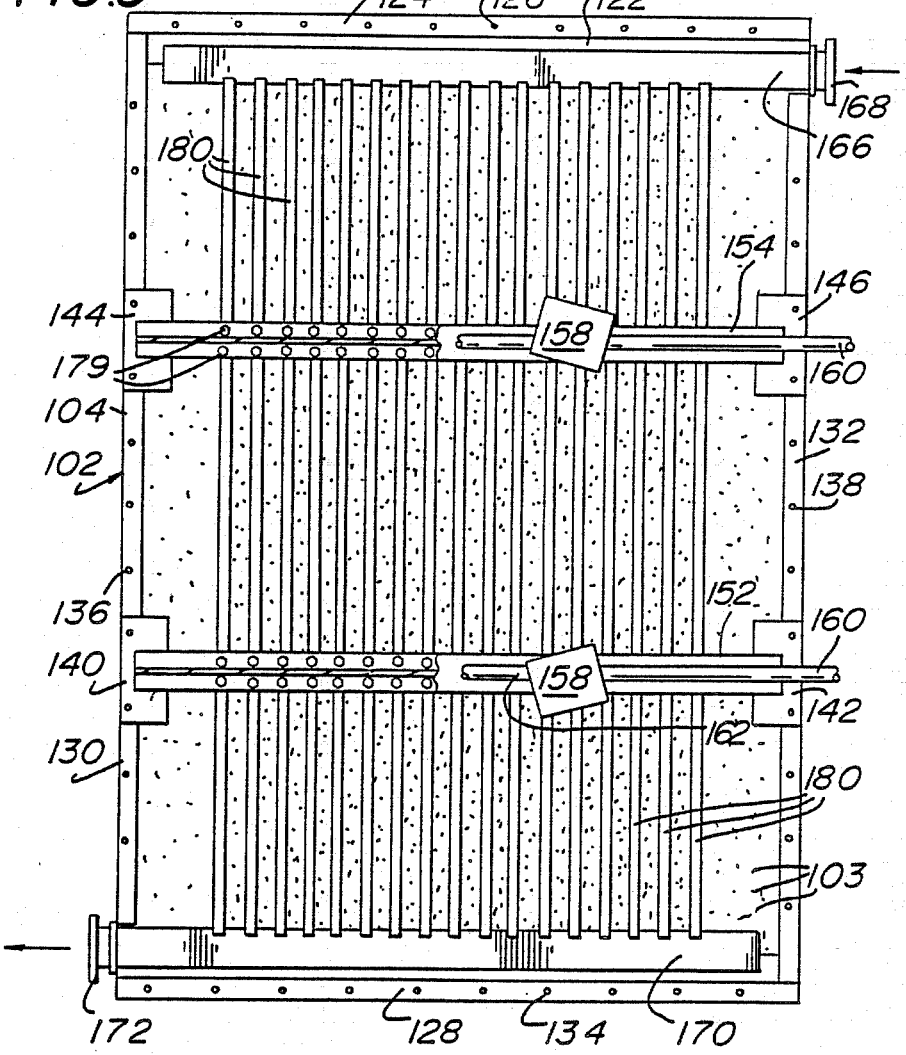
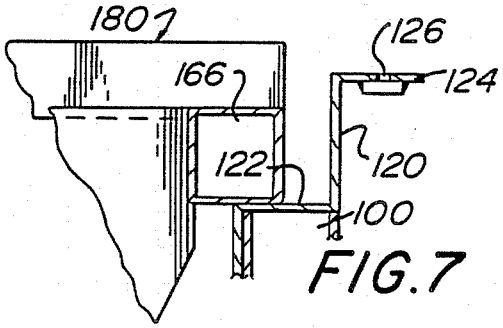
FIG.7

FIG. 4
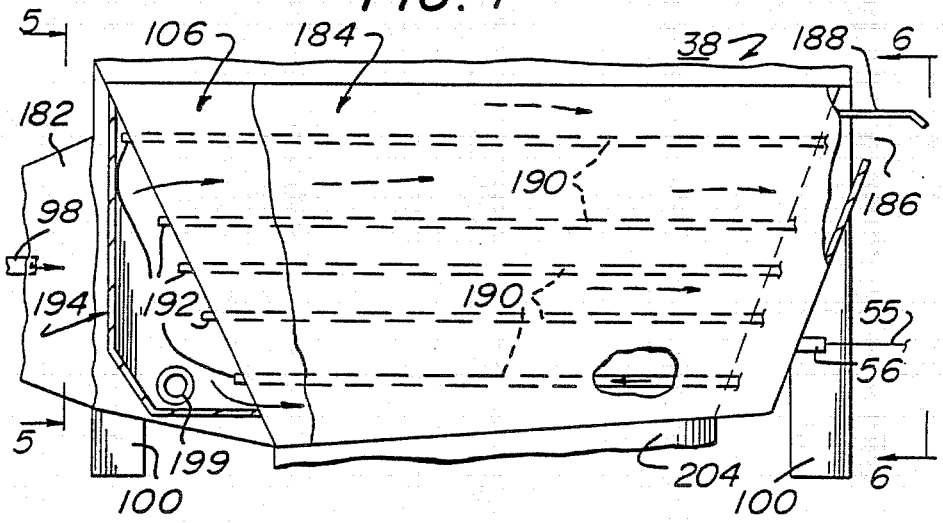
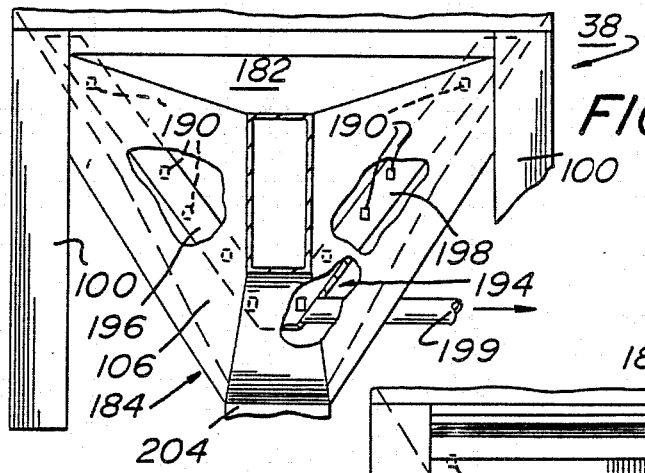
FIG. 5
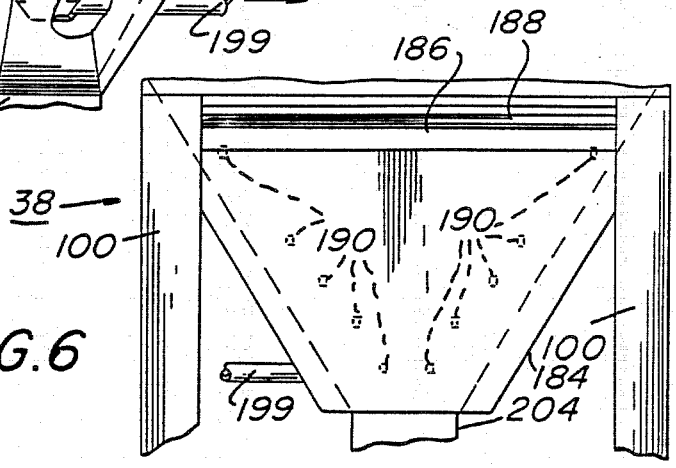
FIG. 6

240B
241B
233
236
242
243
244
245
246
248
250
252
254
256
258A
258B
86
87
88
89
16
17

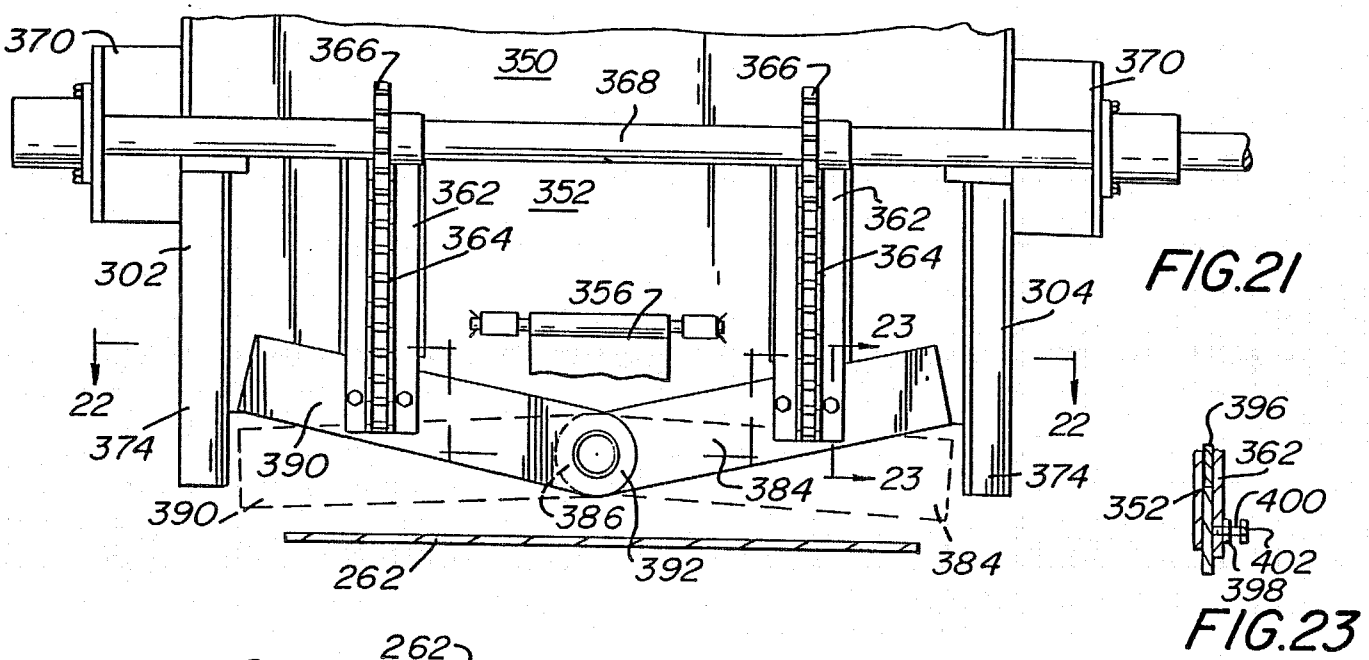
FIG.21
FIG.23
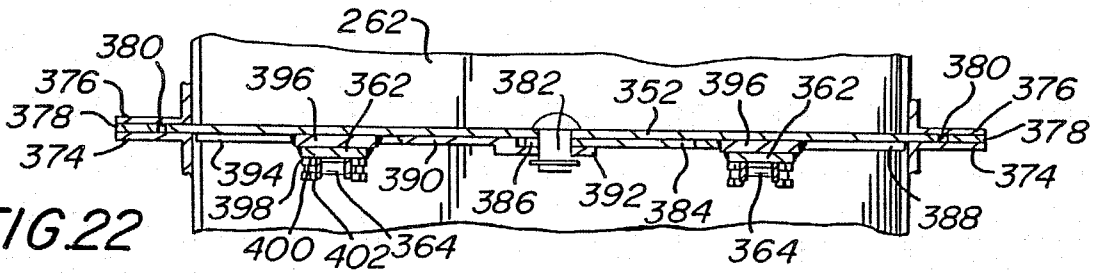
FIG.22

HEATING AND/OR DRYING APPARATUS

BACKGROUND OF THE INVENTION

1. Field of the Invention

The present invention relates to a heating and/or drying apparatus and components used therein. More particularly, the present invention is directed toward a heating and/or drying apparatus well suited for heating and/or drying solid granular or particulate material, such as aggregate comprising rocks, gravel and sand used in making asphalt concrete, for example. The apparatus according to the present invention has a novel construction which allows for the efficient and cost effective indirect transfer of heat energy from and to various parts of the apparatus.

In general, the presently preferred use contemplated for the present invention is to heat and dry aggregate used to make asphalt concrete. The aggregate usually contains a substantial amount of moisture. The amount of moisture within the aggregate can be reduced from the amount contained in the aggregate to zero moisture if desired. However, the heater and heater-condenser of the present invention may be used to heat and/or dry other materials besides the aggregate used for asphalt concrete, including other granular and/or particulate material and, with slight modifications, even liquid material The components of the present invention considered independently of each other, as well as considered in association with each other, represent improvements over current and prior art equipment for heating and/or drying various kinds of materials and particularly aggregate material used to make asphalt concrete 2. Description of the Prior Art One such prior art system is disclosed in the inventor's U.S. Pat. Nos. 4,245,915 entitled "Apparatus for Making Asphalt Concrete," and RE. 32,206 entitled "Process for Making Asphalt Concrete." These patents are directed, inter alia, to a system for heating aggregate in a storage bin indirectly using steam evolved during a subsequent step including heating a mixture of aggregate and binder.

There are other examples of prior art systems which dry various materials, including cement and other aggregate used to make Portland cement concrete, aggregate used to make asphalt concrete, and other solid aggregate and liquid materials. However, none of such systems are believed to provide as efficient and cost effective drying as the present invention. Moreover, the operation of the present invention results in substantially no atmospheric pollution The present invention makes use of the energy value of moisture or other liquid contained in the material to be dried, which is usually lost by evaporation in typical drying or heating systems. The present invention preferably uses substantially all of the heat generated by various components of the system in other components of the system, rather than wasting such heat as in prior art apparatus and processes.

SUMMARY OF THE INVENTION

One aspect of the present invention relates to an apparatus for indirectly heating material containing at least some liquid comprising a preheater-condenser for preheating the material, a heater for heating the preheated material and for generating heater generated heat transfer fluid from the material, first conduit means connecting the preheater-condenser to the heater through which the heater generated heat transfer fluid is carried from the heater to the preheater-condenser, and conveyor means for conveying preheated material from the preheater-condenser to the heater, the preheater-condenser including a housing, inlet means through which the material enters the housing, outlet means for discharging the preheated material from the housing, first hollow heat exchange means supported vertically within the housing, first distributing means connecting the first conduit means and the first hollow heat exchange means for distributing the heater generated heat transfer fluid to the first hollow heat exchange means, and condensate removal means connected to the first hollow heat exchange means for removing from the housing condensed heater generated heat transfer fluid from the first hollow heat exchange means, the heater including a receptacle and a chamber in which the material is heated, a sealable inlet means through which the preheated material to be heated enters the receptacle, but through which gases formed in the heater will not escape to the atmosphere, the chamber having outlet means through which heated material is discharged from the chamber, heating means supported in a vertical orientation within the chamber, a plurality of collecting means supported within the chamber for collecting the heater generated heat transfer fluid from the material being heated, and accumulating means for accumulating the heater generated heat transfer fluid from the plurality of collecting means, the accumulating means being in communication with the collecting means and with the first conduit means through which the heater generated heat transfer fluid flows to the preheater-condenser.

Another aspect of the present invention relates to an apparatus for making asphalt concrete comprising a preheater-condenser for indirectly heating aggregate material containing at least some liquid, a heater for heating the preheated aggregate material and for evolving vapor from the liquid contained in the aggregate material, a first conduit connecting the preheater-condenser and the heater, a first conveyor means for conveying the preheated aggregate material from the preheater-condenser to the heater, a source of binder to be mixed with the aggregate material to form asphalt concrete, a mixer to mix the binder and aggregate material, a second conduit connecting the source of binder and the mixer, a second conveyor means for conveying the heated aggregate material to the mixer, and means for discharging the asphalt concrete from the mixer, the preheater-condenser including a housing, inlet means through which the aggregate material enters the housing, outlet means through which the preheated aggregate material is discharged onto the first conveyor means, and heat exchange means associated with the housing and connected to the first conduit for heating the aggregate material in the housing using the vapor evolved by the heater as a heat transfer fluid, the heater including a chamber in which the preheated aggregate material is heated, the chamber having an inlet in an upper portion of the chamber through which the aggregate material enters the chamber and an outlet in a lower portion of the chamber through which the preheated aggregate material is discharged from the chamber, heating means oriented vertically within the chamber for indirectly heating the aggregate material and evolving vapor from the liquid contained therein, and collecting means for collecting the vapor evolved from the liquid contained in the aggregate material, the collecting means being connected to the first conduit. Still another aspect of the present invention relates to a heat exchange apparatus for indirectly heating material containing at least some liquid comprising a receptacle for holding the material and through which the material passes to a chamber in which the material is heated, a sealable inlet means through which the material enters the receptacle, but through which vapor evolved from the heated material in the apparatus will not escape to the atmosphere, the chamber having outlet means through which heated material is discharged from the chamber, heating means supported by support means in a vertical orientation within the chamber, and collecting means supported within the chamber for collecting the vapor.

Another aspect of the present invention relates to a combination heating and condensing apparatus comprising a housing, inlet means through which material to be heated enters the housing, outlet means for discharging the heated material from the housing, a plate supporting means, a plurality of spaced, generally parallel hollow heat exchange plates supported vertically primarily at the top of the plates within the housing from the plate supporting means, the plates being adapted to contain a heat transfer fluid, at least some of the heat transfer fluid being a gas which condenses within the plates, each plate having an upper portion in which the heat transfer fluid is primarily in a gaseous state and a lower portion in which the heat transfer fluid is primarily in a liquid state, distributing means for distributing the heat transfer fluid from an external source to the plates, and condensate collecting means within the housing for collecting liquid condensed within the plates, first conduit means interconnecting the lower portions of at least some of the adjacent plates, whereby some of the interconnected plates are not in direct communication with the condensate collecting means, the lower portion of at least one of the plates being in direct communication with the condensate collecting means.

Yet another aspect of the present invention relates to a material discharge control apparatus for a discharge gate for a hopper adapted to contain solid granular or particulate material to be discharged from an outlet in a lower portion of the hopper onto a conveyor located below the outlet, the discharge gate being mounted on a side wall of the lower portion of the hopper adjacent the outlet overlying a discharge port formed in the side wall, the discharge gate including inner and outer major surfaces and a lower edge, the discharge gate being operable to allow the material to be discharged below the lower edge through the discharge port onto the conveyor, the material discharge control apparatus being mounted on the discharge gate and comprising at least one plate member including a bottom edge, the plate member being connected to the gate for movement between a first position where the bottom edge of the plate member is below the lower edge of the gate to a second position where the bottom edge of the plate member is no lower than the lower edge of the gate, the plate member in the first position being adapted to contact the discharged material on the conveyor passing below the discharge gate.

Another aspect of the present invention relates to a material flow control apparatus for a hopper adapted to contain solid granular or particulate material to be discharged through a discharge port associated with an outlet in a lower portion of the hopper onto a conveyor located below the outlet, the discharge port being formed in a side wall of the lower portion of the hopper adjacent the outlet, the material flow control apparatus comprising a plurality of bars connected to the lower portion of the hopper adjacent the outlet, the bars being extendable into the interior of the hopper to contact and thereby control the level and the flow of the material to be discharged from the hopper through the discharge port.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is divided into two separate figures, FIG. 1A and FIG. 1B.

FIG. 3 is a horizontal sectional view of the heater apparatus taken along line 3—3 of FIG. 2.

FIG. 4 is a front elevation view, partially broken away and partially in vertical cross section, of the heater illustrated in FIG. 2.

FIG. 5 is a left hand side elevation view, partially broken away and partially in vertical section, of the heater of FIG. 4 taken along line 5—5 of FIG. 4.

FIG. 6 is a right hand side elevation view of the heater of FIG. 4 taken along line 6—6 of FIG. 4.

FIG. 7 is a partial vertical sectional view of the heater of FIG. 2 taken along line 7—7 of FIG. 2 showing a portion of an inlet for heat transfer fluid and associated support structure.

FIG. 21 is an enlarged side elevation view of a material discharge control apparatus of the type illustrated in FIG. 20, the material discharge control apparatus being attached to the side of a hopper and being located above a discharge conveyor.

FIG. 22 is a horizontal sectional view of a portion of the apparatus of FIG. 21 taken along line 22—22 of FIG. 21.

FIG. 23 is a partial vertical sectional view of a portion of the apparatus of FIG. 21 taken along line 23—23 of FIG. 21.

DETAILED DESCRIPTION OF THE PREFERRED EMBODIMENTS

Figure 1A:
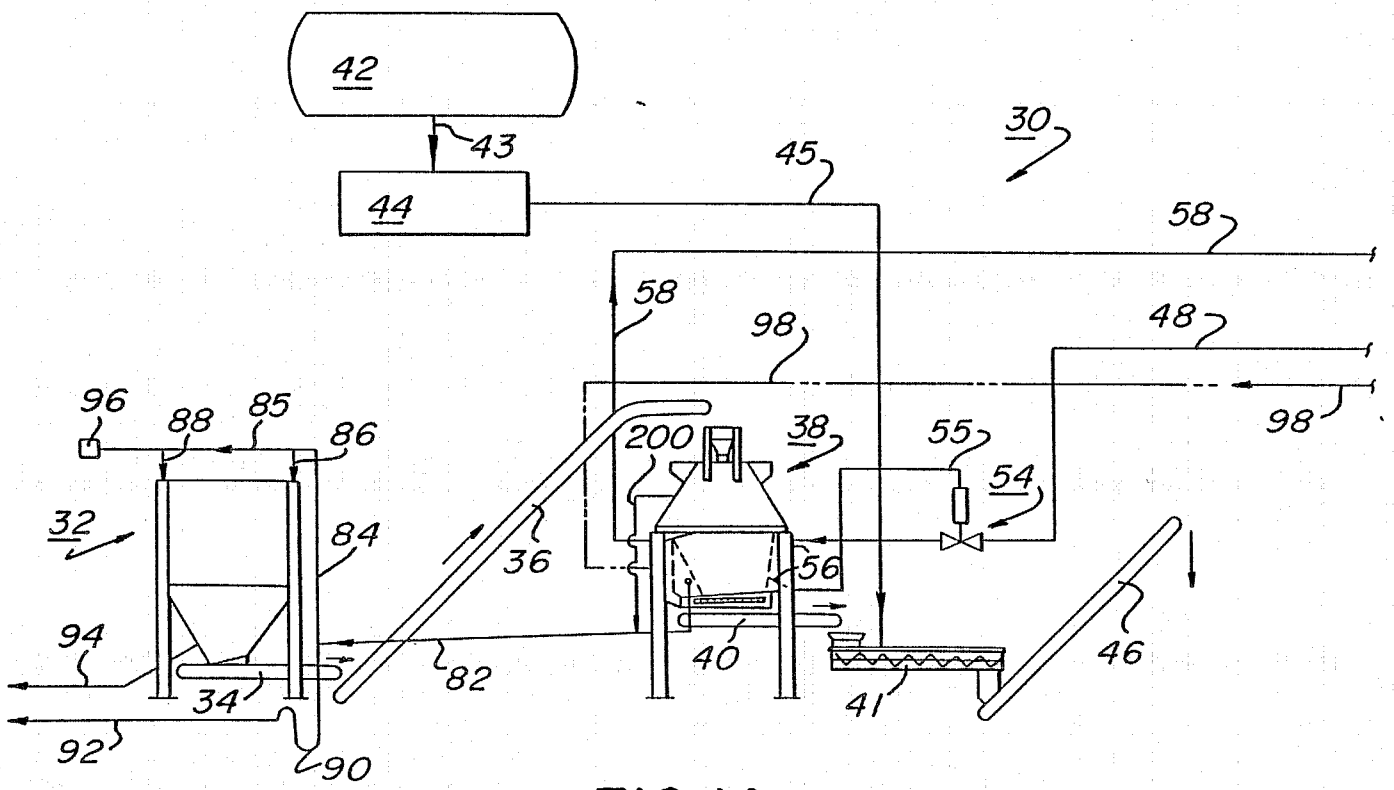
FIG. 1A is a front elevation view, partially including a schematic diagram of the lefthand portion of a system for making asphalt concrete using the apparatus of the present invention.
Figure 1B:
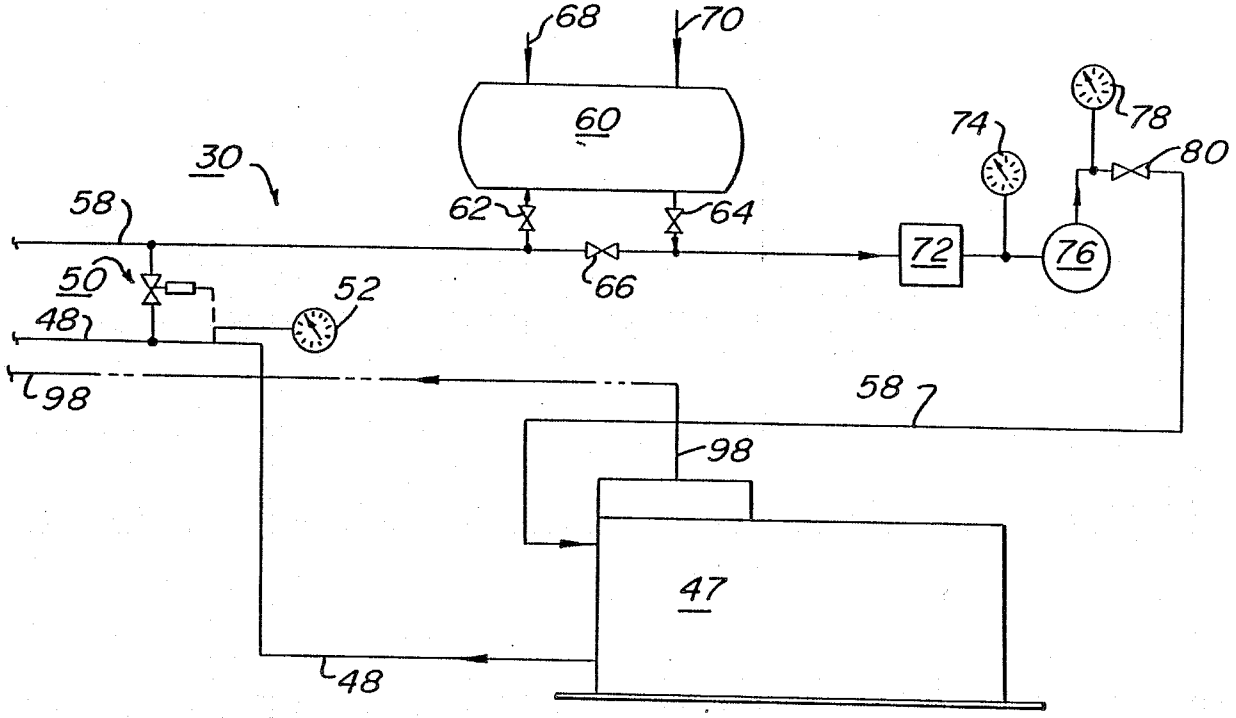
FIG. 1B is a front elevation view partially including a schematic diagram of the right-hand portion of the system of FIG. 1A.

Referring to the drawings in detail, wherein like numerals indicate like elements throughout the several views, there is shown in FIGS. 1A and 1B one type of system 30 incorporating many of the components according to the present invention for the exemplary purpose of making asphalt concrete. It should be understood that the schematic arrangement illustrated in FIGS. 1A and 1B are for purposes of illustration only, and that the apparatus of the present invention can be used for other purposes besides in an asphalt concrete system, and the components may have different orientations in the system than those set forth in the drawings. Nevertheless, so that the detailed descriptions of the individual components of the present invention as set forth hereinafter will be more clear, an overview of the present invention will be described with respect to asphalt concrete system 30.

There are several different types of materials moving to, through and from the various components of system 30. One component is the material to be heated and/or dried, in this specific example aggregate material 15 including small to large particles such as stone, rocks, sand, reclaimed pieces of old asphalt concrete, and the like. Material has been "dried" according to the present invention when the material leaving the various heater components contains relatively less liquid than when the material entered the heater components. For the sake of convenience in describing the heating and/or drying components of the present invention, they will be referred to herein as a "heater," "heater-condenser" or "preheater-condenser" and such terms are to be interpreted to mean that such components may provide a drying function in addition to or in lieu of a heating function.

Other materials moving to, through and from various components of system 30 include two different types of heat transfer fluids. One heat transfer fluid referred to herein as the "primary heat transfer fluid" is preferably in liquid form, although it may be gaseous, and is heated initially by any suitable means such as that described hereinafter. The second heat transfer fluid is a vapor generated by the heater from the liquid contained in the material being heated and/or dried by the primary heat transfer fluid. This second type of fluid is referred to herein as the "heater generated heat transfer fluid."

With reference to FIG. 1A, aggregate material to be heated and/or dried, such as aggregate material, is placed within heater-condenser apparatus 32 which is used in system 30 as a preheater-condenser. The material can be transferred to preheater-condenser 32 by any suitable means, such as bucket conveyors, power shovels, wheel loaders or the like. Material in preheater-condenser 32 is heated by the heater generated heat transfer fluid, as explained hereinafter in more detail, and is discharged by conveyor means 34, such as typical conveyor belt feeder. From belt feeder 34, the initially heated and/or dried aggregate material is transferred by conveyor means 36 into heater apparatus 38. Heater apparatus 38 heats the initially heated and/or dried aggregate material by heat transfer from the primary heater transfer fluid until the aggregate material has a desired final moisture content and/or until the material reaches a predetermined temperature, such as 148.9° C. (300° F.). Because of current asphalt concrete industry standards, it is preferred that the heated and/or dried material be as dry as possible, and most preferred that there be substantially no moisture or other liquid contained in the dried material.

The heated and/or dried material is discharged from heater 38 by conveyor means 40 which conveys the heated and/or dried material into an inlet of a mixer 41. Although conveyor means 40 is illustrated schematically as being a conveyor belt, it could be in the form of a pan feeder or an enclosed auger preferably sealed from the atmosphere to retain the heat of the material and to prevent any uncontrolled atmospheric emissions. Mixer 41 may include inlet and outlet means which are sealable from the atmosphere for the same purpose.

A binder, such as asphalt cement, with or without various additives known to those skilled in the art, may be contained in a source 42, such as a storage tank. The binder is pumped through conduits 43 and 45 by pump 44 into mixer 41. The mixing is accomplished by virtue of an auger, paddles, mixing blades, or the like, within the mixer. The amounts and flow rates of the heated and/or dried aggregate, and binder material, as well as the mixing and discharge rate within mixer 41 may be monitored, adjusted and controlled by typical state-of-the-art controls.

Hot asphalt concrete is discharged from mixer 41 onto a conveyor means 46 for further storage, delivery to trucks, or the like.

Having described the flow of the aggregate material with respect to FIG. 1A, the flow of the heat transfer fluids will now be described initially with reference to FIG. 1B.

Primary heat transfer fluid of a type to be described hereinafter is heated by primary heat transfer fluid heater 47. The heater may include a fossil fuel burner, such as an oil burner, a gas burner or a coal burner, or the heater may be heated electrically. The primary heat transfer fluid may also be heated by solar energy. Most typically, such heaters include fossil fuel burners.

The primary heat transfer fluid leaves heater 47 at a temperature of about 315.6° C. (600° F.) to about 371.1° C. (700° F.), although the temperature could be adjusted to other values, if desired for any given purpose. The fluid flows through conduit 48 and past pressure control device 50. Device 50 including a pressure gauge 52 or other pressure sensor, detects the pressure within conduit 48 and compares it to the maximum pressure which can be sustained in hollow heat exchange plates within heater 38. The device is designed to open the valve associated with the device if the pressure within conduit 48 exceeds the allowable pressure designed for the system within heater 38. When the valve is opened, fluid within conduit 48 is diverted to return conduit 58 until the pressure within conduit 48 is within the desired parameters.

Referring to FIG. 1A, the primary heat transfer fluid then passes through a product (heated and/or dried material) temperature control device 54. Device 54 is electrically connected by wire 55 to a thermocouple or other temperature sensing device 56 to sense the temperature of the heated and/or dried material about to be discharged from heater 38. If the temperature of the material is too low, a valve associated with temperature control device 54 is opened, allowing the hot primary heat transfer fluid to circulate through the heat exchange plates within heater 38. If the temperature exceeds the desired limit, the valve of device 54 closes. If this happens, the pressure will build in conduit 48, triggering the opening of the valve associated with pressure control device 50. Thus, the operation of pressure control device 50 and temperature control device 54 are interrelated and coordinated by suitable state-of-the-art monitoring and control equipment.

The primary heat transfer fluid then exits from heater 38 through return conduit 58. The now cooler primary heat transfer fluid passes by pressure control device 50 and then past the primary heat transfer fluid expansion tank 60. Valves 62, 64 and 66 may be opened and closed as necessary to remove moisture from the primary heat transfer fluid and to allow for primary heat transfer fluid expansion. Nitrogen or other inert gas used to maintain a system blanket pressure in expansion tank 60 may enter through inlet 68 through suitable valves (not shown). Primary heat transfer fluid can be added to the system by adding it to expansion tank 60 through inlet 70, preferably containing suitable valving (not shown).

The primary heat transfer fluid may be a gas, such as super-heated steam, or preferably a liquid, such as hot oil, commercially available synthetic heat transfer fluids or commercially available molten salt mixtures, such as a mixture of potassium nitrate, sodium nitrite and sodium nitrate. Selection of the appropriate primary heat transfer fluid will depend upon such factors as availability, cost, temperature ranges desired, and the like. In general, the criteria for the proper selection of an appropriate primary heat transfer fluid is well within the realm of those of ordinary skill in the art.

The primary heat transfer fluid passes through strainer 72 and past pressure gauge or other sensor 74. Then it is pumped by pump 76 past another pressure gauge or sensor 78 and through suitable valving 80. From there, the primary heat transfer fluid is heated or re-heated by heater 47, and the cycle is repeated.

At present, it may be most economical to use a fossil fuel burning heater for the primary heat transfer fluid heater 47. Particularly with fossil fuel burning heaters, substantial heat and energy value is lost through exhaust gases (generally 15–20%). The present invention also provides for the substantial recovery of this lost heat.

In the present invention, instead of exhausting the combustion gases directly to the atmosphere, the gases, typically at a temperature of about 370° C. (700° F.), are routed from heater 47 through conduit 98 (see FIG. 1B) to a housing surrounding at least the heating chamber portion of at least heater 38 (see FIG. 1A). The heat contained in the exhaust gases can be transferred indirectly through an inner housing wall to the material to be dried and then exhausted through an outlet in the housing.

If desired, the exhaust gas from heater 47 could be transferred in a like manner to surround preheater-condenser 32 either solely or in addition to the transfer to heater 38.

Within heater 38, the aggregate material containing some moisture or other liquid is heated to the point where the liquid is evaporated to form a vapor or gas. The evolved vapor or gas becomes the heater generated heat transfer fluid described above, and exits heater 38 through conduit 82. Conduit 82 connects to delivery conduits 84 and 85 which, in turn, connect to inlet manifolds 86 and 88 associated with hollow heat exchange plates contained within preheater-condenser 32. Although conduits 82 and 84 preferably are insulated to reduce the heat loss through the walls of the conduits, some condensation may occur, which is removed through trap 90 and condensate removal conduit 92. The heat exchange plates within preheater-condenser 32 result in the heating, or preheating in this particular system, of the aggregate material. As the aggregate material is heated, much if not most of the gas within the hollow heat transfer plates condenses within preheater-condenser 32. The condensate is collected and removed from the preheater-condenser through conduit 94. A gas vent valve 96 is provided to bleed off air entrained within the system.

System 30 can operate in a batch, semi-continuous or continuous mode. Because of the residence time of the aggregate in heater 38, and in view of the indirect heat transfer process taking place in heater 38, primary heat transfer fluid heater 47 may at times have excess capacity. To utilize the excess capacity, particularly when the system is operating in a batch or semi-continuous mode, primary heat transfer fluid heater 47 may be connected by a plurality of conduits 48 and 58 to a plurality of heaters corresponding to heater 38. Appropriate sensing means and valving would direct the hot primary heat transfer fluid to the particular heater requiring the fluid at any particular time.

System 30 has been described to provide a basic understanding of the overall operation of several major components of the present invention, and particularly preheater-condenser 32 and heater 38. With this understanding as background, the construction and operation of the various novel components of the present invention will be described in detail.

Figure 2:
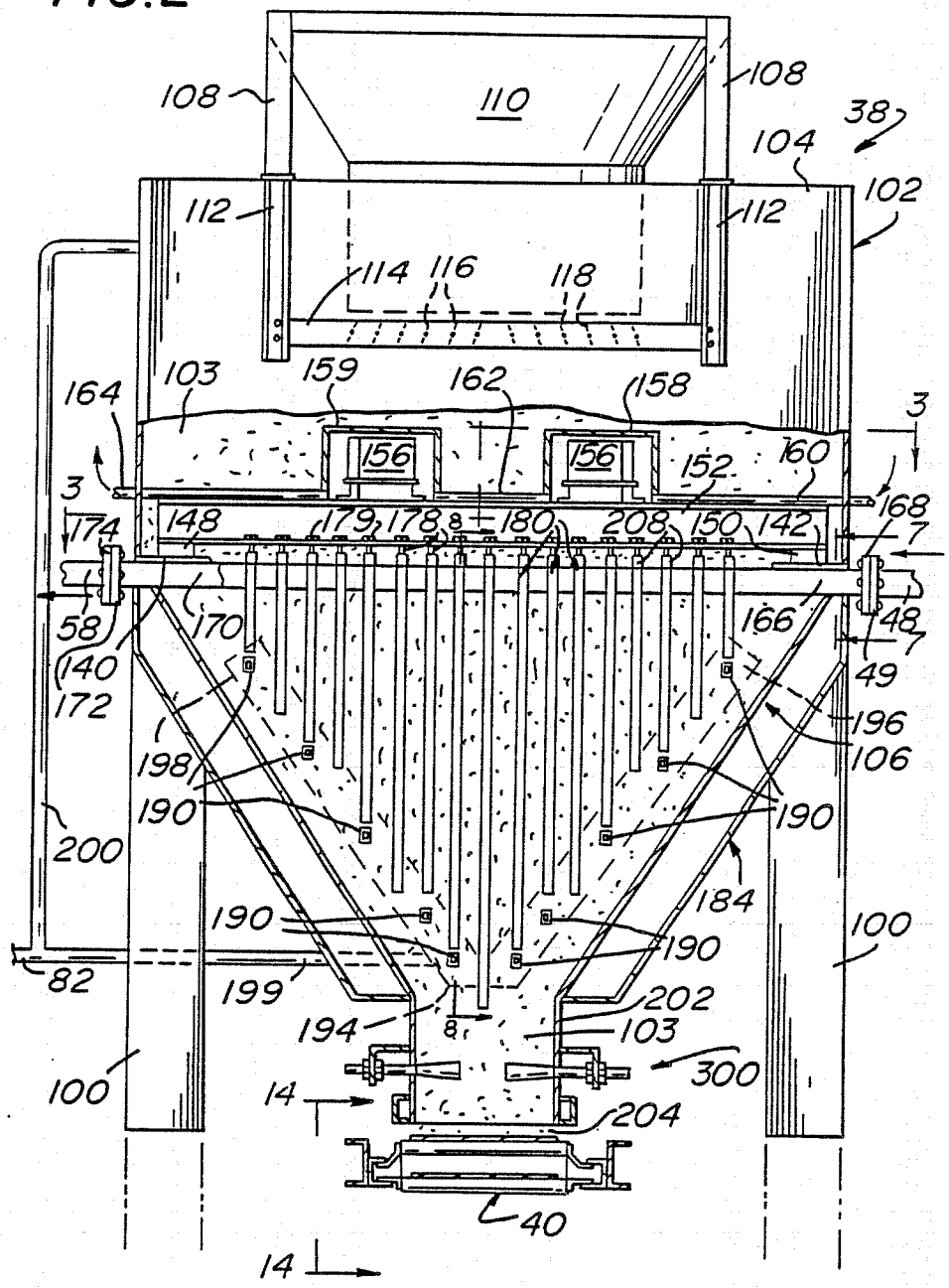
FIG. 2 is a right hand side elevation view, partially in vertical cross section, of a heater apparatus according to the present invention.

Details relating to heater 38 are illustrated in FIGS. 2 through 13. To have a common frame of reference, FIG. 1A is considered a front view, whereby FIG. 2 is a side view, partially in vertical cross section, of the right hand side of heater 38, FIG. 4 primarily is a front view, FIG. 5 is primarily a left side view, and FIG. 6 is primarily a right side view of heater 38.

Heater 38 comprises support legs 100 which are supported in a conventional manner on any suitable foundation, portable trailer equipped with jack supports, or the like. Support legs 100 are attached to a housing 102 by any suitable means, such as by welding, nuts and bolts, rivets, or other fastening means. Appropriate bracing and other framework may be used as required, and need not be described herein in detail. Housing 102 may be of any desired shape and may include inwardly sloping lower walls as illustrated, front, rear and side walls which are substantially vertical from the top to the bottom, or any other shape as desired Housing 102, which preferably contains a solid, flowable material containing at least some liquid to be evaporated, may be an integral structure, but preferably comprises an upper portion 104 which is preferably welded or otherwise sealingly attached to a lower portion 106. The upper portion functions primarily as a receptacle for receiving material 103 to be dried. Lower portion 106 functions primarily as a heating chamber.

Attached to the top of receptacle 104., preferably to suitable framing members, are support members 108 which support a sealable inlet hopper 110. Hopper 110 receives aggregate from conveyor 36 and represents the only inlet into receptacle 104. Since receptacle 104 must be sealed from the atmosphere during its operation to be most efficient, hopper 110 must have appropriate sealing means. For operation in a continuous mode, hopper 110 may have a screw conveyor which carries sufficient material and is so dimensioned that it effectively seals the receptacle 104 from the atmosphere. Other suitable sealable inlet means useable with hopper 110 include star valve, air cylinder operated gates or the like.

Support members 112 depend from the frame structure or are supported by support members 108. Attached to support members 112 is a splitter bar 114. A plurality of adjustable diverting vanes 116 are mounted on splitter bar 114. As illustrated in FIG. 2, vanes 116 are oriented to divert material toward the left hand portion of the Figure, while vanes 118 are oriented to divert material toward the right hand portion of the Figure. The vanes may be adjusted by rotating them about a horizontal axis to distribute material 103 evenly within housing 102.

Referring now primarily to FIG. 7, a support angle bracket 120 is illustrated as being supported on support leg 100. Angle bracket 120 includes a shelf portion 122 and a horizontal flange portion 124. These elements are illustrated at the top of FIG. 3. The support angle bracket typically is attached to lower portion 106 of housing 102. Receptacle portion 104 of housing 102 typically is attached to flange 124 by bolts and nut extending through holes 126 formed in flange portion 124. Corresponding flange portions extend around the perimeter of portion 104 of housing 102 as identified by flanges 128, 130 and 132 having a plurality of holes 134, 136 and 138, respectively. Appropriate gasket material may be placed between the flanges of upper and lower housing portions 104 and 106, respectively, to assure a fluid tight seal.

FIG. 7 illustrates a portion of heater 38 and shows the relative positions, prior to final assembly, of the support structure and a preferred embodiment of the heating means used in the heater. More specifically, FIG. 7 shows the interrelationship during the assembly of the heater among one of a plurality of hollow heat exchange plate assemblies 180 of the heating means, an associated inlet manifold 166 and the support structure. During assembly, one end of the heat exchange plate assemblies 180 are supported by manifold 166 which initially rests on shelf 122 of support angle bracket 120. When the apparatus is entirely assembled, and during operation, heat exchange plate assemblies 180 are suspended from above in a manner described hereinafter such that there is a space between the bottom of manifold 166 and the top of shelf 122. A similar structure supports manifold 170 associated with the other end of heat exchange plate assemblies 180 (See FIG. 3).

With reference to FIGS. 2 and 3, a plurality of support blocks 140, 142, 144 and 146 (FIG. 3) may be supported by support angle brackets 130 and 132. Support blocks 140 and 142 are illustrated in FIG. 2. Elastomeric pads 148, 150 are attached to the upper surface of support blocks 140 and 142 by a suitable means, such as by bonding with a suitable adhesive. Likewise, there are pads attached to support blocks 144 and 146, although such pads are not visible in the drawings. The pads may be made of any suitable material which can withstand the particular environment, including high temperatures, and which can absorb shocks associated with a vibrating beam supported on the pads.

Support beam 152 is supported on and bolted through pads 148 and 150. Likewise, beam 154 is supported on pads mounted to support blocks 144 and 146. A plurality of hollow heat exchange plate assemblies 180 are attached to and depend from beams 152 and 154 in a manner described hereinafter.

At least one vibrating means 156, and preferably two such means 156, are secured to each beam 152 and 154. The vibrating means may be any suitable type, such as a motor driven eccentric wheel or other conventional device. Housings 158 and 159 protect vibrators 156. Although the tops of housings 158 and 159 are illustrated as being flat in FIGS. 2 and 3, if desired, they could be arched, pointed or the like to aid material flow around the vibrators. Power lines and a cooling fluid, such as air, are supplied to vibrators 156 through through inlet conduit 160 and intermediate conduits 162. The cooling fluid continues to flow through outlet conduit 164.

Figures 8, 9, 10, 11, 12, 13:
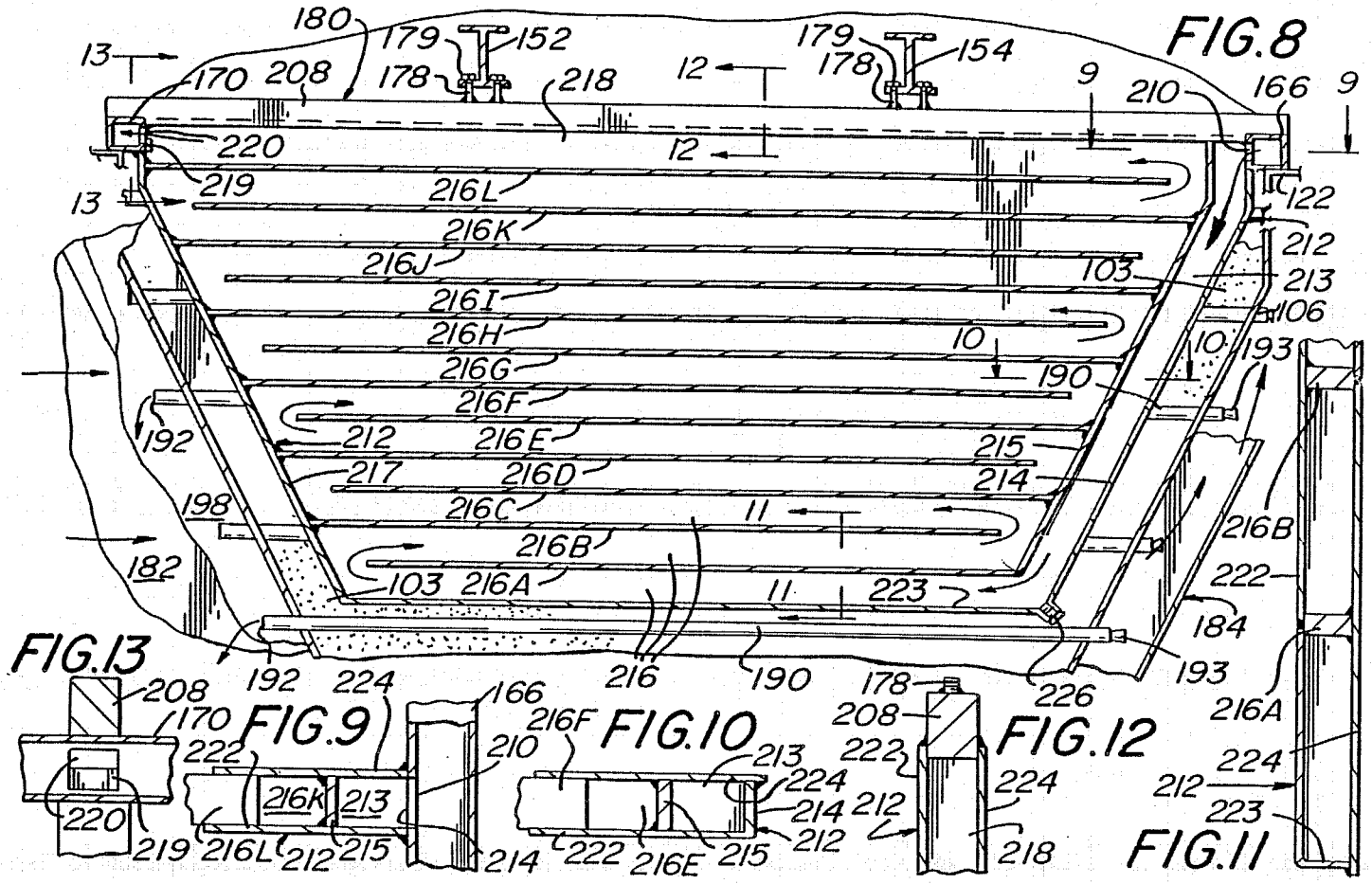
FIG. 8 is a partial vertical sectional view of the heater of FIG. 2 taken along line 8—8 of FIG. 2.
FIG. 9 is a partial horizontal sectional view of the portion of the heater illustrated in FIG. 8 taken along line 9—9 of FIG. 8.
FIG. 10 is a partial horizontal sectional view of the portion of the heater illustrated in FIG. 8 taken along line 10—10 of FIG. 8.
FIG. 11 is a partial vertical sectional view of a portion of the apparatus illustrated in FIG. 8 taken along the line 11—11 of FIG. 8.
FIG. 12 is a partial vertical sectional view of a portion of the apparatus of FIG. 8 taken along line 12—12 of FIG. 8.
FIG. 13 is a vertical sectional view of the portion of the apparatus illustrated in FIG. 8 taken along line 13—13 of FIG. 8.

Hollow heat exchange plate assembly 180 will now be described briefly, with a more detailed description to follow hereinafter. FIGS. 2, 3 and 8 best illustrate how hollow heat exchange plate assemblies 180 are supported by support beams 152 and 154. Each heat exchange plate assembly includes a top support bar 208 to which threaded studs 178 are welded or otherwise attached. Studs 178 pass through holes in lower flanges of support beams 152 and 154 and are retained in place by nuts 179.

An inlet manifold 166 is attached to the upper outer side wall of all heat exchange plate assemblies 180 below support bars 208 by means such as welding. Inlet manifold 166 includes a flange 168 which attaches to a flange 49 of primary heat transfer fluid supply conduit 48 by suitable fasteners in the usual manner. A sealed, sliding expansion joint accommodates the passage of manifold 166 through the wall of housing 102 while maintaining the interior of the housing in a sealed condition.

An outlet manifold 170 is attached to the top of the opposite side wall of all of the heat exchange plate assemblies 180 below support bars 208 by means, such as welding. Outlet manifold 170 has a flange 172 which is fastened in a conventional manner to flange 174 of primary heat transfer fluid return conduit 58.

As described more particularly hereinafter, hot primary heat transfer fluid is delivered through conduit 48 into inlet manifold 166. From there, the hot primary heat transfer fluid flows through the hollow heat exchange plate assemblies 180. The primary heat transfer fluid then flows out of the heat exchange plate assemblies through outlet conduit 170, where it enters return conduit 58. The aggregate or other material 103 is heated indirectly by virtue of the heat transfer from the primary heat transfer fluid through the walls of plate assemblies 180. Although the preferred embodiment of the heating means used in the heater to indirectly heat the aggregate includes the hollow heat exchange plate assemblies 180 and the associated primary heat transfer fluid delivery system as they are described herein in detail, other heating means may be used to indirectly heat the aggregate, such as electric resistance heating plates, for example.

As the aggregate is heated, water or other liquid contained therein begins to evaporate. The evolved vapor or gas, which becomes the heater generated heat transfer fluid, flows through a number of orifices formed in the bottom surface of sparger tubes 190 aligned below at least some of the heat exchange plate assemblies 180. The sparger tubes are a part of an evolved vapor collecting assembly or means 194 which includes a generally V-shaped collection chamber (best illustrated in FIGS. 2, 4 and 5). Collecting means 194 includes legs 196 and 198 in fluid connection with open ends 192 of sparger tubes 190 (FIG. 8). The opposite ends of sparger tubes 190 are closed as by caps or plugs 193 (FIG. 8).

The evolved vapor collected in collecting means 194 flows through a removal conduit 199 to conduit 82 (FIG. 2). Since some of the evolved vapor may find its way to the upper portion of receptacle 104, another vapor removal conduit is provided having one end in fluid communication with the top of receptacle 104 and the other end in fluid communication with vapor removal conduit 199 or conduit 82.

The general operation of heater 38 should be apparent from the foregoing description. In general., aggregate or other material to be heated and/or dried enters sealable inlet hopper 110. The material flows through the hopper, is diverted by vanes 116 and 118 to fill heating chamber 106 and at least partially fill receptacle 104. To aid the material flow and heat transfer, vibrators 156 are turned on, by which support beams 152 and 154, and therefore heat exchange plate assemblies 180 are vibrated. Aggregate 103 flows downwardly between heat exchange plate assemblies 180 and along the walls of heating chamber 106 to outlet portion 202. As described in more detail hereinafter, a material flow control apparatus 300 preferably is used to aid in directing the flow of the aggregate onto a conveyor out of the open bottom 204 and preferably through a novel material discharge control apparatus 350 to be described hereinafter. The hot, dried aggregate is thereby discharged onto conveyor 40 for further processing.

As mentioned above, the present invention includes the recovery of heat generated by primary heat transfer fluid heater 47 which often is wasted. The wasted heat, which may be in the form of hot combustion gases, flows through conduit 98 to heater 38 as illustrated in FIG. 1A, although conduit 98 could also direct such hot gases to preheater-condenser 32.

For the sake of clarity, a description of how the waste heat is used at heater 38 or preheater-condenser 32 is illustrated and will be described only with respect to heater 38, particularly with reference to FIGS. 2 and 4 through 6.

Conduit 98 is attached by welding, flanges or other suitable fastening means to a waste heat recovery housing inlet 182. Inlet 182 is attached to a waste heat recovery housing 184 which surrounds the entire heating chamber 106, including evolved vapor collecting means 194. As indicated in FIG. 4, the hot combustion gases flow between waste heat recovery housing 184 which forms the outside wall, and the collection chamber of collecting means 194 and heating chamber 106, which together form the inner walls of the space through which the combustion gases flow. The hot combustion gases exit housing 184 through opening 186 which is protected from the elements by rain cover or shield 188. If desired, the walls of housing 184 could be insulated to reduce heat loss through the walls.

The details of the construction of hollow heat exchange plate assemblies 180 will now be described with reference to FIGS. 8 through 13.

Each hollow heat exchange plate assembly 180 includes a support bar 208 supported by beams 152 and 154 as described above. A hollow heat exchange plate 212 is attached, preferably by welding, to support bar 208. Inlet manifold 166 and outlet manifold 170 are attached to the top side wall of hollow plate 212, also as described above. An entry orifice 210 allows for the entry of primary heat transfer fluid from inlet manifold 166 into inlet channel 213 formed between outer wall 214 and inner wall 215 of hollow plate 212. The flow of the primary heat transfer fluid is illustrated by the arrows in FIG. 8, beginning with the arrow extending from inlet manifold 166 into channel 213. After the fluid flows through channel 213, it enters into a series of preferably parallel, generally horizontal serpentine channels 216 formed between interior channel walls 216A through 216L. Interior serpentine channel walls 216A, 216C, 216E, 216G, 2161 and 216K extend from interior side wall 215, but do not extend all of the way to opposite side wall 217. Interior serpentine channel walls 216B, 216D, 216F, 216H, 216J and 216L extend from side wall 217, but do not extend all of the way to opposite side wall 215.

The primary heat transfer fluid flows upwardly through serpentine channels 216 until it reaches exit channel 218. From channel 218, primary heat transfer fluid enters outlet manifold 170 through orifice 220. Exit orifice 220 has a size defined by an opening in the interior wall of manifold 170 communicating with channel 218. So that there is a balanced pressure drop among all of the relatively shorter and relatively longer hollow heat exchange plates within the heater, the exit orifices 220 of the various heat exchange plates are adjusted to have proper dimensions. The longest central heat exchange plate communicates with manifold 170 through an exit orifice 220 having a large area. Shorter heat exchange plates, such as the heat exchange plate illustrated in FIG. 8, have smaller exit orifices. As illustrated in FIGS. 8 and 13, an orifice plate 219 is welded or otherwise attached to the wall of manifold 170 adjacent the interior of channel 218 to restrict the size of exit orifice 220. The shorter hollow heat exchange plates have larger orifice plates corresponding to plate 219, so that they have correspondingly smaller exit orifices 220. If desired, orifice plates of the type described with respect to orifice plate 219 could be used in conjunction with the entry orifices 210, rather than with the exit orifices 220, to provide for the balanced flow of primary heat transfer fluid throughout the several heat exchange plates.

Hollow heat exchange plate 212 includes a first or front major face 222 which is fastened, such as by welding, at the top to support bar 208, and at the bottom, after curving to form bottom wall 223, to a second or rear major face 224. Interior walls 216A through 216L are welded between major faces 222 and 224. A drain opening and removeable plug 226 are formed in a lower corner of hollow heat exchange plate 212.

Heater 38 is constructed to enable the relatively easy removal and/or replacement of all of the hollow heat exchange plate assemblies 180 as a unit attached to support beams 152 and 154. The removal is relatively easy, since beams 152 and 154 are merely bolted through the rubber pad mounted on support blocks 140, 142, 144 and 146. Inlet and outlet manifolds 166 and 170 can have flanges of a conventional structure within housing 102 to allow for the easy removal of the hollow heat exchange plate assemblies.

While a preferred use of heater 38 is in the system 30 of the present invention as described above, heater 38 may be used with other systems either with preheater-condenser 32 or as a separate heating unit.

The construction and operation of preheater-condenser 32 will now be described in detail. Initially, it should be emphasized that, although apparatus 32 is used in system 30 as a preheater-condenser, it may be used in other systems, if desired, as a heater-condenser. Nevertheless, for the sake of clarity, apparatus 32 will be described herein in its presently preferred use as a preheater-condenser.

Figure 14:
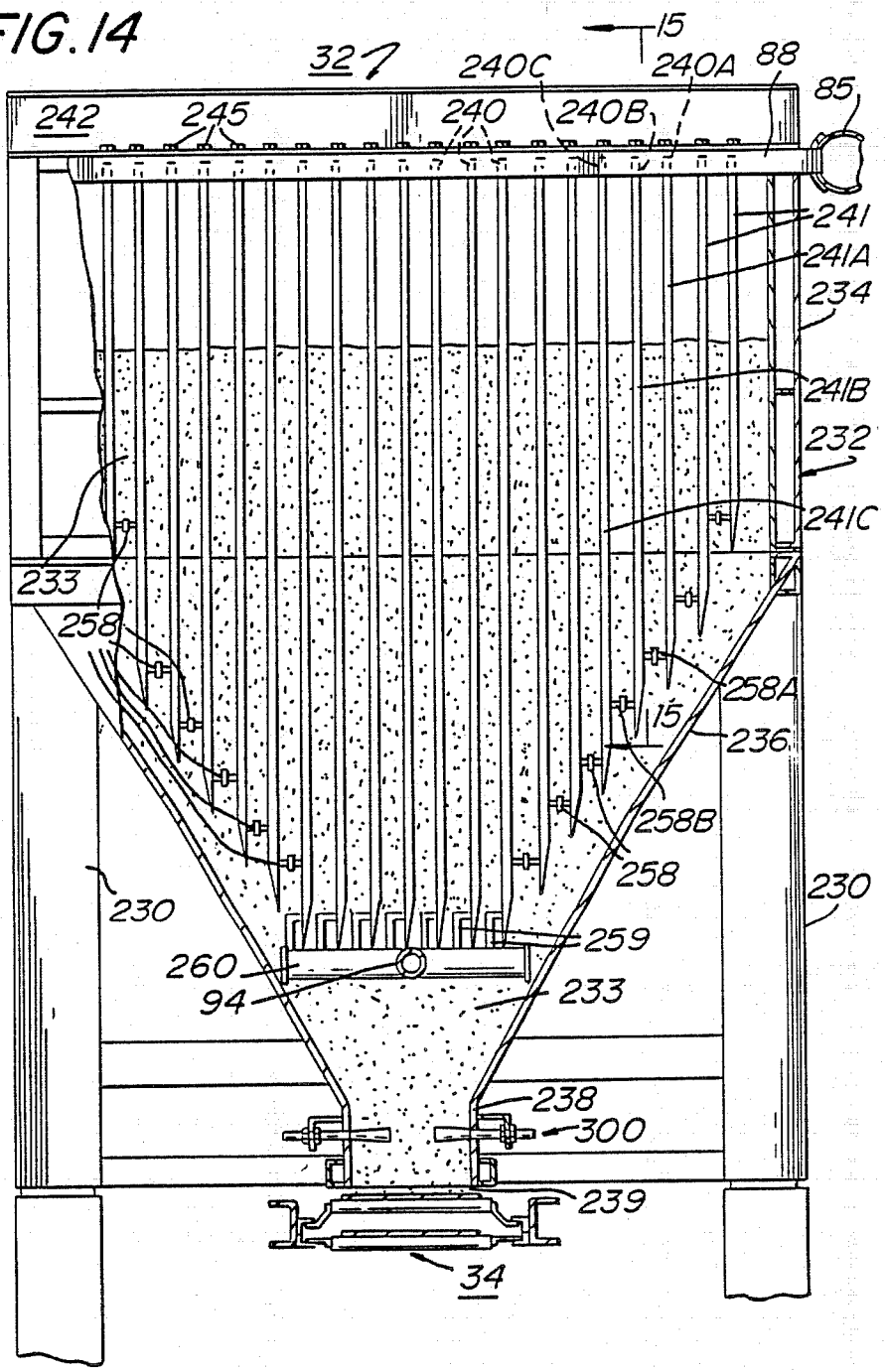
FIG. 14 is a side elevation view, partly broken away and partly in vertical cross section, of a heater-condenser apparatus and associated material handling means according to the present invention.

With reference to FIG. 14, apparatus 32 includes support legs 230 for supporting the apparatus on any type of conventional foundation, directly on the ground, on a portable trailer equipped with jack supports, etc. The apparatus includes a housing 232 which may be in the form of a storage bin, silo, hopper or the like containing material 233 to be dried, heated or preheated. Housing 232, which may be insulated if desired, includes an upper, generally rectangular portion 234 and a lower portion 236 generally having at least two, and preferably four, downwardly and inwardly sloping walls. The housing can have any other desired shape, including substantially vertical, nonsloping side walls. Lower portion 236 has an outlet portion 238 terminating in an open bottom 239. An optional material flow control apparatus 300 to be described in detail hereinafter, is illustrated in FIG. 14 as being attached to outlet portion 238. Heated or pre-heated material 233 is discharged from preheater-condenser apparatus 32 by belt conveyor means 34, an equivalent pan feeder, or the like, for further processing.

Unlike heater 38, preheater-condenser 32 preferably has an open top and is not sealed from the atmosphere.

Figures 15, 16, 17, 18:
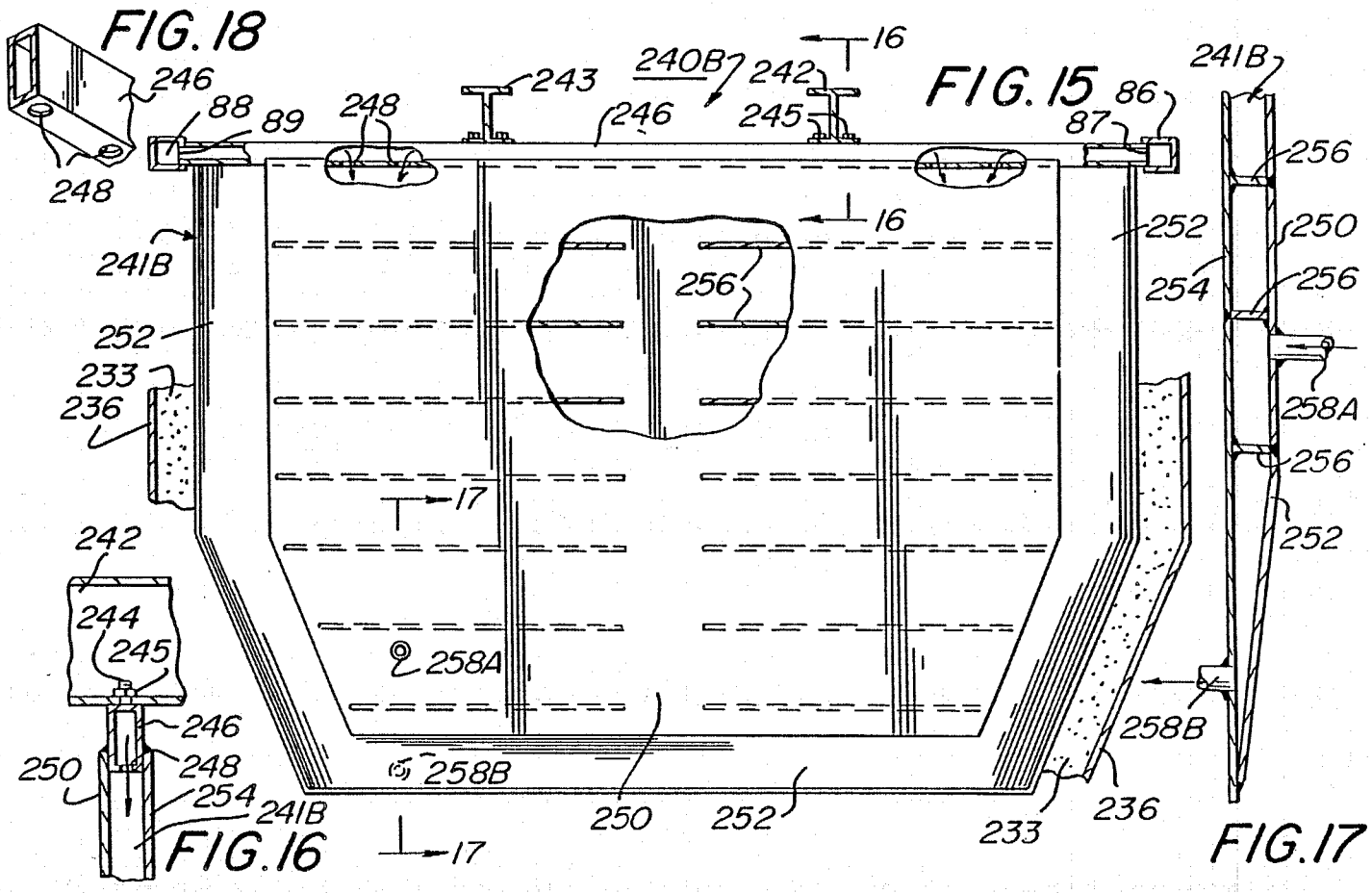
FIG. 15 is a partial vertical sectional view of a portion of the apparatus of FIG. 14, partly broken away, and taken along line 15—15 of FIG. 14.
FIG. 16 is a partial vertical sectional view of the portion of the heater-condenser of FIG. 15 taken along line 16—16 of FIG. 15.
FIG. 17 is a partial vertical sectional view of a portion of a heat exchange plate illustrated in FIG. 15 taken along line 17—17 of FIG. 15.
FIG. 18 is a partial bottom perspective view, partly in vertical cross section, of a vapor inlet manifold used with the heater-condenser apparatus illustrated in FIGS. 14 through 16.

Preheater-condenser 32 includes a plurality of hollow heat exchange plate assemblies 240. The plate assemblies are supported by and depend from support beams 242, 243 as best illustrated in FIGS. 15 and 16 If desired, vibrating means, such as vibrators 156 (FIGS. 2 and 3) as used with heater 38, can be mounted on beams 242 and 243 of the preheater-condenser. The use of vibrators makes the aggregate or other solid particulate material flow through housing 232 more efficiently, but the use of such vibrators is not required.

Hollow heat exchange plate assemblies 240 include hollow heat exchange plates 241, each of which is attached to and in communication with a heat transfer fluid inlet header 246 as described below. Threaded studs 444 are welded or otherwise attached to the upper wall of inlet header 246. Studs 244 are then inserted through holes in the bottom flanges of beams 242 and 243 and nuts 245 are threaded onto studs 244 to support hollow heat exchange plates 241 from beams 242 and 243.

With reference to FIG. 14, it is apparent that hollow heat exchange plate assemblies 240 are of varying length. The shorter hollow plate assemblies are located adjacent the side walls of housing 232 to accommodate the sloping walls of lower portion 236. The number, size an spacing of the plates within housing 232 can be selected based on the type and size of material expected to be dried, the type of heat transfer fluid to be used, the type and shape of the preheater-condenser housing and other such considerations.

The construction of the hollow heat exchange plate 241 will now be described with particular reference to one typical hollow heat exchange assembly 240B illustrated in FIGS. 15 through 17.

Hollow heat exchange plate 241 includes a first or front major face 250 having angled side and bottom margins 252 which are welded to a second or rear major face 254. The upper portions of major faces 250 and 254 are welded to the outside of header 246 as best illustrated in FIG. 16. Fluid communication between header 246 and the interior of hollow heat exchange plate 241 is provided through a plurality of orifices 248 formed in the bottom wall of header 246.

A plurality of internal walls 256 are welded between front and rear faces 250 and 254 to provide reinforcement. The orientation of walls 256 are for purposes of illustration only and need not be located as illustrated. The orientation illustrated should provide both reasonable flow and retention of the heat transfer fluid within heat exchange plates 241.

Heat transfer fluid, which may be the heater generated heat transfer fluid as defined above where preheater-condenser 32 is used in system 30 of FIGS. 1A and 1B, flows through delivery conduit 85 (FIGS. 1A and 14) to inlet manifolds 86 and 88 (FIGS. 1A and 15). From inlet manifolds 86 and 88, the heat transfer fluid flows through orifices 87 and 89, respectively, into header 246. From header 246, the fluid flows through orifices 248 into the interior of plates 241.

By virtue of the heat transfer from the heat transfer fluid through the walls of plates 241 to the material 233 being dried, preheated or heated, the heat transfer fluid, initially preferably a vapor or gas, condenses within plates 241. Accordingly, it is necessary to have a condensate collecting means preferably located within the housing for collecting liquid condensed within the plates. In general, the heat transfer fluid will tend to be primarily gaseous in the upper portion of each plate 241, but primarily in a liquid state in a lower portion of plate 241. The lower portions of the adjacent plates 241 are interconnected by conduits 258, best illustrated in FIGS. 14 and 17. Connecting conduits 258 are welded to opposite faces of adjacent plates. Thus, for example, with reference to FIG. 14, connecting conduit 258A connects the lower portions of plates 241A and 241B. Connecting conduit 258B connects the lower portions of plate 241B and 241C.

The above-described connections using conduits 258 relate to interconnecting plates of different lengths so that the condensed heat transfer fluid flows downwardly by gravity. A different condensate collection arrangement may be used with the longest plates in the central portion of housing 232. For the longest plates, connecting conduits 260 connect the lower portion of the plates to a condensate collecting manifold 260. A condensate outlet means in the form of a condensate removal conduit 94 (FIGS. 1A and 14) is connected at one end to manifold 260 and at the other end to a suitable storage tank or drain for holding or draining off the condensate as desired under the circumstances It should be mentioned that the heat exchange plates 241 in preheater-condenser 32, as well as the heat exchange plates 212 used in heater 38, may be made of any suitable material capable of transferring heat through the walls of the plates and capable of withstanding the wear and tear associated with movement of tons of aggregate or other similar, solid particulate material through the apparatus. The presently preferred material is carbon steel. The housings for preheater-condenser 32 and heater 38 may be made of any suitable durable material, but steel is the presently preferred material.

Preheater-condenser 32 and heater 38 may be built to have any desired capacity. Typical commercial capacities for both preheater-condenser 32 and heater 38 are from about 75 to about 150 tons per hour of aggregate or other material to be heated, dried and discharged.

Two basic novel components may be used to enhance the flow and discharge of material from preheater-condenser 32 and/or heater 38. The first is a material flow control apparatus 300 best illustrated in FIGS. 19 and 20 and material level control apparatus 350 best illustrated in FIGS. 19 through 23. Apparatus 300 and 350 are optional with the preheater-condenser and with the heater. Apparatus 300 and 350 can be used alone or together on any type of particulate material handling equipment in which solid particulate material flows first downwardly where it is discharged through a hopper having an opening in the bottom onto a conveyor belt moving generally horizontally. Material discharge control apparatus 350 may be used when a hopper has a side opening discharge port in a lower portion of the hopper.

The material flow control apparatus 300 will be described first.

Material flow control apparatus 300 may be used on the bottom of the hopper in conjunction with any suitable conveyor, but it is presently preferred to use an endless belt conveyor 40 of generally typical construction. Conveyor 40 may be secured to the support legs or other frame structure supporting the housing for the preheater-condenser or heater.

Figure 19:
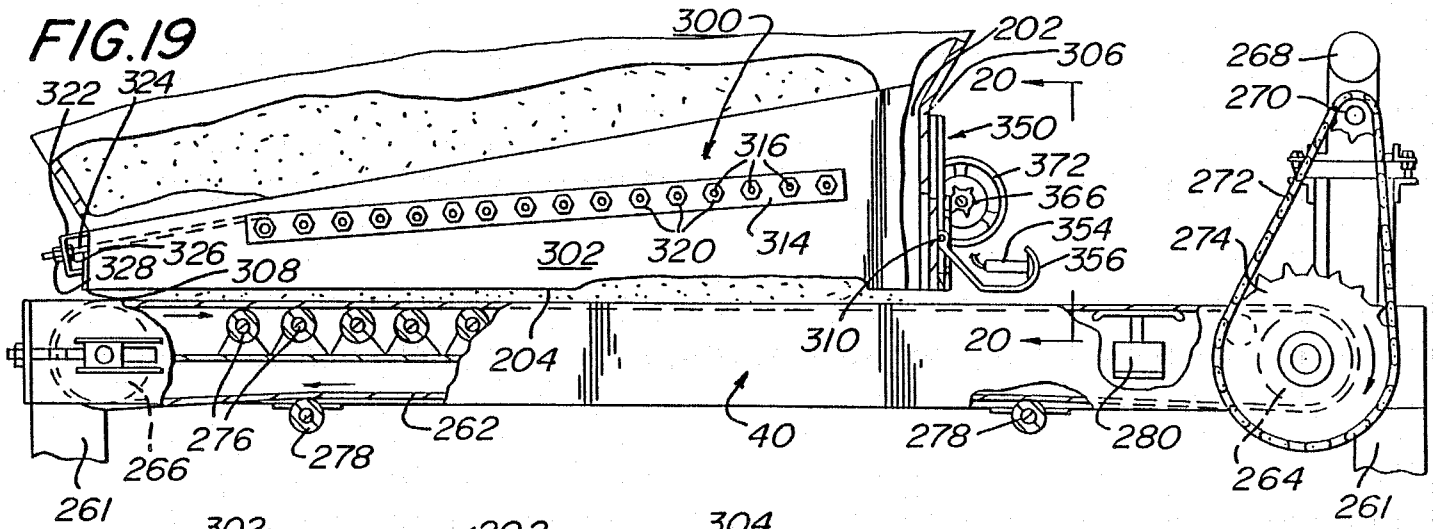
FIG. 19 is a front elevation view, partly broken away and partly in vertical cross section, showing a material discharge control apparatus according to the present invention and a material flow control apparatus according to the present invention which may be used in conjunction with an aggregate hopper of the type used in the heater apparatus of FIG. 2 and/or the heater-condenser apparatus of FIG. 14, together with an associated discharge conveyor means.

With reference to FIG. 19, conveyor 40 is supported by a conveyor support frame 261. An endless belt 262 has a width at least as wide as the distance between the front and rear walls of lower outlet portion 202 of the hopper housing. The length of the conveyor belt 262 should be such that it extends from left side wall 308 to beyond right side wall 306 as illustrated in FIG. 19. The upper flight of belt 262 should be maintained close to the bottom opening 204 of the hopper housing, on the order of 1.25 cm (0.5 inch) for asphalt concrete aggregate. The spacing between the top flight of 262 and the open bottom 204 of the hopper housing should be at least slightly larger than the largest sized particles expected to be discharged from the hopper. If desired, as presently preferred, conveyor 40 is angled downwardly slightly in the direction of the material flow such that the left hand portion of the conveyor illustrated in Figure 19 is higher than the right hand side of the conveyor Side flashing members 282 (FIG. 20) of a type well known to those skilled in the art prevents the aggregate or other dried material from passing laterally through the space between the top flight of belt 262 and open bottom 204 of the hopper other than in the desired direction of the belt travel as indicated by the arrows in FIG. 19.

Endless belt 262 passes around driven roller 264 and an adjustable freely rotatable roller 266. Driven roller 264 is driven by any suitable motor 268 through a transmission including a motor sprocket 270, a drive chain 272 and a roller sprocket 274. Idler rollers 276 support the upper flight of belt 262 and idler rollers 278 support the lower flight of belt 262.

Material flow control apparatus 300 can be mounted on any or all of the walls of the hopper housing. However, in the presently preferred embodiment illustrated in FIGS. 19 and 20, material flow control apparatus 300 is mounted on front wall 302, rear wall 304 and left side wall 308. The material flow control apparatus is mounted in an identical manner on front and rear walls 302 and 304, respectively. Accordingly, the same numerals will be used to identify corresponding parts on each of the front and rear walls.

The material flow control apparatus includes a mounting bracket 314 which is attached, preferably by welding, to hopper walls 302 and 304. A plurality of material flow control bars 316 pass through holes in wall 302 and in wall 304 and through aligned holes in mounting bracket 314. Flow control bars 316 preferably include a threaded exterior shaft and an enlarged interior end portion 317. The threaded exterior portion of bars 316 preferably end in a shape that can be driven, such as a square or hexagonal end to be driven by a wrench, or a slotted end, so hat the bar can be turned by a screw driver. Enlarged interior end portion 317 preferably has a conical shape with the base of the cone being oriented toward the middle portion of the housing.

A nut or other internally threaded member 318 is welded or otherwise attached to mounting bracket 314 in alignment with the hole through which the shaft of the flow control bar extends. The threads on the exterior of the control bar shaft meet with the internal threads of nut 318 by which rotation around the longitudinal axis of the control bars 316 cause them to move into and out of the hopper. Bars 316 are maintained in the desired position by means of a lock nut or other internally threaded member 320.

As illustrated in FIG. 19, mounting bracket 314 preferrably is arranged to incline upwardly such that the upper end is closer to discharge port 310 and the lower end is farther from the discharge port. This incline allows for the even flow of material out of the hopper through discharge port 310. The left end of mounting bracket 314, and therefore the flow control bars, are closer to the top flight of belt 262, but not so close as to obstruct the largest particle. The right end of bracket 314 and the associated flow control bars is at about the height of the upper wall of discharge port 310. As the top flight of conveyor belt 262 moves from left to right, the material deposited on the belt adjacent the left side wall 308 is moved under the material being deposited on the belt adjacent to right side wall 306. To help prevent blockage from the added material traveling on the conveyor belt from left to right, the higher inclined portion of the flow control bars allows slightly more material into the area below the control bars on the right hand side, compared to the left hand side. In this way, about the same amount of material is deposited on the belt from all portions of the hopper.

The inclination of bracket 314, and therefore the flow control bars, is presently preferred to be about 2 to about 2½ degrees from the horizontal. The top flight of the conveyor belt or other discharge device, such as a pan feeder, is presently preferred to have a downward inclination from left to right of between about 2½ degrees and about 4 degrees. The bar spacing is presently about 10 centimeters (4 inches) center to center. Of course, the spacing can be adjusted to any desired amount to provide the desired even flow characteristics, based on parameters such as the size and shape of the material being discharged, the size, shape and volume of the hopper, etc.

A mounting bracket 322 is attached by welding or other suitable means to the left side wall 308. Aligned holes are formed in the side wall and the mounting bracket. Nuts or other internally threaded members 326 are welded or otherwise attached to mounting bracket 322 in alignment with the holes. Flow control bars 324 having external threads on at least a portion of their shafts are threaded through nuts 326. Lock nuts 328 maintain flow control bars 324 in the desired location with the desired amount of extension within the hopper.

Although only one flow control bar 324 is illustrated in the drawings, it should be apparent that a plurality of such control bars and associated nuts 326 and 328 are used in conjunction throughout the width of left side wall 308. Moreover, the shape of control bars 324 may be the same as control bars 316, although it is presently preferred that the bars have the same general cross sectional area throughout their length. Flow control bars 324 are most conveniently made in the shape of cylindrical rods, although other shapes can be used as desired to control the flow.

Material flow control apparatus 300, by virtue of bars 316 and 324, aids in controlling the even downward flow of the aggregate or other granular or particulate material being heated, dried or otherwise processed in and being discharged from a hopper. The flow control bars cause the material to be discharged evenly along the upper flight of endless belt 262, rather than preferentially along the side or middle portion of the hopper. By adjusting the shape and extension of the bars into and out of the hopper, the flow of the material out of the hopper can be customized to the particular shape of the hopper, the type and shape of material being discharged, desired flow rates and the like.

Material discharge control apparatus 350 will now be described with reference to FIGS. 19 through 23. The discharge control apparatus is associated with a discharge gate 352 overlying discharge port 310 in right side wall 306 in lower portion 202 of the hopper adjacent bottom opening 204. Discharge gate 352 includes a lower edge 353 best illustrated in phantom in FIG. 20. A material flow switch 354 is attached to a pivoting mounting assembly 356 which is attached by an axle pin 358 to pin support bearing members 360 welded or otherwise secured to gate 352. When material is being discharged from the hopper onto conveyor 40, flow switch 354 and mounting assembly 356 will be in the position illustrated in FIG. 19. The switch sends a signal to a control center verifying that material is flowing. When no material is being discharged from the hopper, mounting assembly 356 pivots clockwise when viewed in FIG. 19. Switch 354 signals the control center that no material is being discharged, so that the various processing parameters can be controlled as appropriate.

Figure 20:
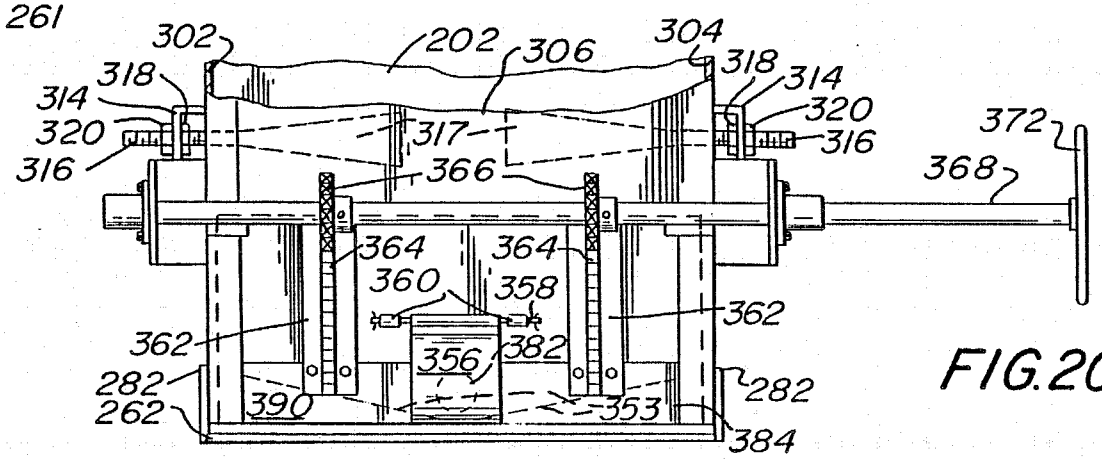
FIG. 20 is a partial side view of a portion of the apparatus illustrated in FIG. 19 taken along line 20—20 of FIG. 19.

Two vertically oriented clamp plates 362 are welded or otherwise attached to the outer surface of gate 352 as best illustrated in FIGS. 20, 21 and 22. A rack 364 is mounted vertically on each clamp plate 362. Pinions 366 are mounted on a shaft 368 such that the teeth in the pinions are aligned and mesh with mating openings in racks 364. Shaft 368 is supported for rotational movement by bearings 370 attached to walls 302 and 304. A handle 372 is a attached to the shaft. With reference to FIG. 19, when handle 372 is rotated clockwise, pinions 366 interacting with racks 364 raise discharge gate 352. Counterclockwise rotation of the handle lowers discharge gate 352.

As best illustrated in FIGS. 21 and 22, discharge gate 352 is supported for vertical sliding motion between oppositely aligned outer gate mounting brackets 374 attached to front and rear walls 302 and 304, respectively, and inner gate mounting brackets 376 likewise are attached to the walls. Spacer elements 378 having a thickness slightly greater than the thickness of gate 352 maintain a proper channel between outer and inner gate mounting brackets 374 and 376 to provide for the smooth raising and lowering of the gate.

It should be apparent from FIG. 19 that, if gate 352 is raised, more material can be discharged onto conveyor 40 than if the gate is lowered. Often, it is desired to control the profile and level of the material being discharged on a conveyor belt so that the material is most efficiently discharged from the apparatus. To control the profile or level of the material on belt 262, there is provided at least one, and preferably, as best illustrated in FIGS. 20 through 22, two level control plates 384 and 390 attached to the lower portion of discharge gate 352 by a pivot pin 382. Level control plate 384 includes a first end 386 through which pivot pin 382 extends and a second end 388 which is adjacent to the right side edge of discharge gate 352. Level control plate 390 includes a first end 392 offset from the plane of level control plate 390 as illustrated best in FIG. 22, and a second end 394 adjacent to the left edge of discharge gate 352. Plates 384 and 390 are pivotable about pivot pin 382 and may be adjusted to a raised position as indicated by the solid lines of FIG. 21, to a lower position as indicated in phantom in FIG. 21. The level control plates may be raised and lowered independently of each other and may be separately adjusted and locked into any desired position. One typical position is illustrated in FIG. 20 in which plates 384 and 390 are both adjusted such that their lower edges are horizontal and substantially parallel to the upper flight of endless belt 262.

Level control plates 384 and 390 are locked in the desired position as best illustrated in FIGS. 22 and 23. The level control plate, for example plate 384 illustrated in FIG. 23 can be raised to a position limited by a stop member 396 secured between the outer surface of discharge gate 352 and the inner surface of clamp plate 362.

Nuts or other internally threaded members 398 are welded or otherwise attached to clamp plate 362 in alignment with a hole extending through the clamp plate. Bolts 400, each having a threaded shaft to mate with the internal threads of nuts 398, also have a head 402 by which the bolts can be turned. When the bolts 400 are screwed into nuts 398, the ends of the bolts bear against the level control plates 384 and 390 and push the plates into contact with the outer surface of discharge gate 352. The plates thus are held firmly between the bolts and the discharge gate.

As indicated above, material discharge control apparatus 350 may be used in conjunction with or separately from the use of material flow control apparatus 300. The separate use of material discharge control apparatus 350 is shown in FIG. 21 where none of the components of material flow control apparatus 300 are illustrated. It is believed that material discharge control apparatus 350 will be particularly useful when it is attached to a hopper that does not include material flow control apparatus 300, because in this circumstance, the material probably would not be discharged from the hopper as evenly as when material flow control apparatus 300 is being used.

The present invention may be embodied in other specific forms without departing from the spirit or essential attributed thereof and, accordingly, reference should be made to the appended claims, rather than to the foregoing specification, as indicating the scope of the invention.

What is claimed:

1. Apparatus for indirectly heating aggregate material containing at least some liquid comprising a preheater-condenser for preheating the material, a heater for heating the preheated material and for generating a vaporous heater generated heat transfer fluid from the material, first conduit means connecting the preheater-condenser to the heater through which the heater generated heat transfer fluid is carried from the heater to the preheater-condenser, and conveyor means for conveying preheated material from the preheater-condenser to the heater, the preheater-condenser including a housing, inlet means through which the material enters the housing, outlet means for discharging the preheated material from the housing, first hollow heat exchange means supported vertically within the housing, first distributing means connecting the first conduit means and the first hollow heat exchange means for distributing the heater generated heat transfer fluid to the first hollow heat exchange means, and condensate removal means connected to the first hollow heat exchange means for removing from the housing condensed heater generated heat transfer fluid from the first hollow heat exchange means, the heater including a receptacle and a chamber in which the material is heated, a sealable inlet means through which the preheated material to be heated enters the receptacle, but through which gases formed in the heater will not escape to the atmosphere, the chamber having outlet means through which heated material is discharged from the chamber, heating means supported in a vertical orientation within the chamber, a plurality of collecting means supported within the chamber for collecting the heater generated heat transfer fluid from the material being heated, and accumulating means for accumulating the heater generated heat transfer fluid from the plurality of collecting means, the accumulating means being in communication with the collecting means and with the first conduit means through which the heater generated heat transfer fluid flows to the preheater-condenser.

2. Apparatus according to claim 1 wherein the heating means includes electric resistance heating means.

3. Apparatus according to claim 1 wherein the condensate removal means for the preheater-condenser comprises a condensate collecting means for collecting condensate from within the first hollow heat exchange means, a condensate outlet means extending from the housing, and second conduit means connecting the condensate collecting means and the condensate outlet means, whereby the condensate is drained from the condensate collecting means to a location outside of the preheater-condenser.

4. Apparatus according to claim 1 further comprising a source of a primary heat transfer fluid, and second conduit means connecting the source to the heater, and wherein the heater further comprises second distributing means for distributing the primary heat transfer fluid to the heating means within the heater chamber, the heating means comprising second hollow heat exchange means.

5. Apparatus according to claim 1 wherein the source of the primary heat transfer fluid is a fossil fuel burning heating device which produces hot gas as a result of combustion of the fuel, and wherein at least one of the heater chamber of the heater and the housing of the preheater-condenser is substantially surrounded by a heating jacket having walls spaced therefrom, the jacket including an entrance port through which the hot gas enters the jacket and an exhaust port through which the hot gas is exhausted from the jacket.

6. Apparatus according to claim 1 wherein at least one of the preheater-condenser and heater further comprises vibrating means mounted on support means for the respective first hollow heat exchange means, and the heating means for vibrating the respective first hollow heat exchange means and the heating means.

7. Apparatus according to claim 6 wherein the vibrating means is mounted on both the preheater-condenser and the heater.

* * * * *